US009425501B2

(12) United States Patent
Desclos et al.

(10) Patent No.: US 9,425,501 B2
(45) Date of Patent: Aug. 23, 2016

(54) COMPOSITE THERMOFORMED ASSEMBLY

(75) Inventors: Laurent Desclos, San Diego, CA (US); Jeffrey Shambiin, San Marcos, CA (US)

(73) Assignee: ETHERTRONICS, INC., San Diego, CA (US)

( * ) Notice: Subject to any disclaimer, the term of this patent is extended or adjusted under 35 U.S.C. 154(b) by 555 days.

(21) Appl. No.: 13/449,283

(22) Filed: Apr. 17, 2012

(65) Prior Publication Data

US 2012/0285611 A1 Nov. 15, 2012

Related U.S. Application Data

(63) Continuation-in-part of application No. 12/337,639, filed on Dec. 18, 2008, now Pat. No. 8,179,323.

(60) Provisional application No. 61/037,278, filed on Mar. 17, 2008, provisional application No. 61/496,878, filed on Jun. 14, 2011.

(51) Int. Cl.

| | |
|---|---|
| ***H01Q 1/40*** | (2006.01) |
| ***H01Q 1/38*** | (2006.01) |
| ***H01P 11/00*** | (2006.01) |
| ***H01Q 5/378*** | (2015.01) |

(52) U.S. Cl.

CPC ..... *H01Q 1/38* (2013.01); *H01P 11/003* (2013.01); *H01Q 1/40* (2013.01); *H01Q 5/378* (2015.01); *Y10T 156/1044* (2015.01)

(58) Field of Classification Search

None

See application file for complete search history.

(56) References Cited

U.S. PATENT DOCUMENTS

| | | | | |
|---|---|---|---|---|
| 5,495,260 | A * | 2/1996 | Couture | H01Q 9/285 343/700 MS |
| 2004/0150561 | A1* | 8/2004 | Tillery et al. | 343/700 MS |
| 2005/0040394 | A1* | 2/2005 | Wu | C07D 333/08 257/40 |
| 2008/0085390 | A1* | 4/2008 | Neill et al. | 428/76 |
| 2009/0183829 | A1* | 7/2009 | Rendek et al. | 156/285 |
| 2009/0231206 | A1* | 9/2009 | Shamblin et al. | 343/700 MS |
| 2012/0235879 | A1* | 9/2012 | Eder et al. | 343/873 |

* cited by examiner

*Primary Examiner* — Barbara J Musser

(74) *Attorney, Agent, or Firm* — Coastal Patent Law Group, P.C.

(57) ABSTRACT

Methods for producing cost effective and reliable antennas and circuits for wireless devices are disclosed. The antennas and circuits are formed by applying a conductive layer to one side of a carrier sheet and attaching a second carrier sheet to encapsulate and protect the conductive layer. The combination of the two carrier sheets and the conductive layer are then formed into one or more three-dimensional antenna structures or circuits in a thermoforming process. This technique enables high volume production of antennas and RF circuits in a fast, reliable, and cost-efficient manner that provides for encapsulation of the conductive layer. The plurality of antennas and circuits formed in this fashion may then be separated by a cutting apparatus to obtain individual devices that are ready for integration into myriad communication devices.

9 Claims, 9 Drawing Sheets

SINGLE RESONANCE ISOLATED MAGNETIC DIPOLE (IMD)

TOP VIEW SIDE VIEW

DUAL RESONANCE ISOLATED MAGNETIC DIPOLE (IMD)

TOP VIEW SIDE VIEW

IMD WITH ADJACENT PARASITIC ELEMENT

SIDE CONFIGURATION "A" SIDE CONFIGURATION "B"

COMPOSITE THERMOFORMED ASSEMBLY

CROSS-REFERENCE TO RELATED APPLICATIONS

This application is a continuation-in-part of U.S. patent application Ser. No. 12/337,639, filed Dec. 18, 2008, now U.S. Pat. No. 8,179,323 which claims priority to Provisional Ser. No. 61/037,278, filed Mar. 17, 2008, and further claims priority to Provisional Ser. No. 61/496,878, filed Jun. 14, 2011; the contents of each of which are hereby incorporated by reference.

FIELD OF INVENTION

This invention relates generally to the field of wireless communications. In particular, the invention relates to antennas, circuits, and methods for forming antennas and circuits for use in wireless communications.

BACKGROUND OF THE INVENTION

With the proliferation of wireless products and services, device manufacturers are forced to aggressively pursue cost reduction opportunities in the manufacturing and assembly of wireless device components. Reduction of costs associated with wireless antennas and electronic assemblies may thus be an important factor in staying competitive. Implementation of a cost-effective antenna may become even more critical as new features and functionalities are added to wireless devices that require more sophisticated antennas and circuits.

An internal antenna and/or feed network for a wireless device is typically manufactured as either a stamped metal element or as a flex-circuit assembly on a plastic carrier. Each of these techniques suffers from high cost of production. The stamped metal element and the plastic carrier each require expensive and time consuming tooling for high volume production. Furthermore, while the flex-circuit antenna may be readily fabricated using a standard etching process, this technique is typically a more expensive solution compared to a stamped metal element.

SUMMARY OF THE INVENTION

It is an object of the various embodiments of the present invention to provide methods of forming cost effective and reliable wireless antennas and feed networks. In one aspect of the invention, a method for forming an antenna or circuit comprises providing a first non-conductive carrier sheet, applying a conductive layer to the first carrier sheet, and applying a second non-conductive carrier sheet such that the conductive layer is disposed between each of the first and second non-conductive sheets, and forming one or more antennas or circuits by thermoforming the combined carrier sheets and the conductive layer.

In one embodiment, at least one of the non-conductive carrier sheets comprises one or more apertures for providing conductive engagement of the antenna or circuit formed from the conductive layer to the electronic assembly or transceiver. In another embodiment, the non-conductive carrier sheets substantially cover the conductive layer, and a connection is made to the electronic assembly or transceiver by capacitive coupling.

In another embodiment, a thermo-setting adhesive is applied between the first and second layers of non-conductive sheets to provide a permanent attachment of the thermoformed assembly. In one embodiment, the printing is conducted in accordance with a stencil printer. According to another embodiment, the carrier sheet comprises a plastic sheet. In yet another embodiment, the forming produces a plurality of three-dimensional antennas that are separated into individual antenna structures with a cutting apparatus.

In another embodiment, a plurality of non-conductive layers are incorporated along with a plurality of conductive layers to produce multiple conductive layers separated by non-conductive layers for providing multiple antennas and/or circuits in a single three-dimensional structure. In this regard, the multiple antennas can be individually tuned and configured to collectively provide multi-band coverage.

In yet another embodiment, the forming produces one or more antennas or circuits on a tape portion of a tape-on-reel package. In another embodiment, the forming further produces one or more protrusions for connecting at least one of a ground and an electrical feed associated with the antennas to a circuit board. The one or more protrusions fit into one or more depressions on the circuit board. In another embodiment, the forming further produces one or more contact bumps for connecting at least one of a ground and an electrical feed associated with the antennas to a circuit board.

Another aspect of the present invention relates to an antenna comprising a non-conductive portion, a conductive portion, and one or more protrusions for connecting at least one of a ground and an electrical feed associated with the antenna to a circuit board. The antenna is formed by applying a conductive layer to a non-conductive carrier sheet and thermoforming the combined carrier sheet and conductive layer.

Those skilled in the art will appreciate that various embodiments discussed above, or parts thereof, may be combined in a variety of ways to create further embodiments that are encompassed within the scope of the claimed invention.

BRIEF DESCRIPTION OF THE DRAWINGS

The characteristics and advantages of this invention will become more apparent from the following detailed description when read in conjunction with the accompanying drawings, in which.

DETAILED DESCRIPTION OF THE PREFERRED EMBODIMENTS

Figure 1:
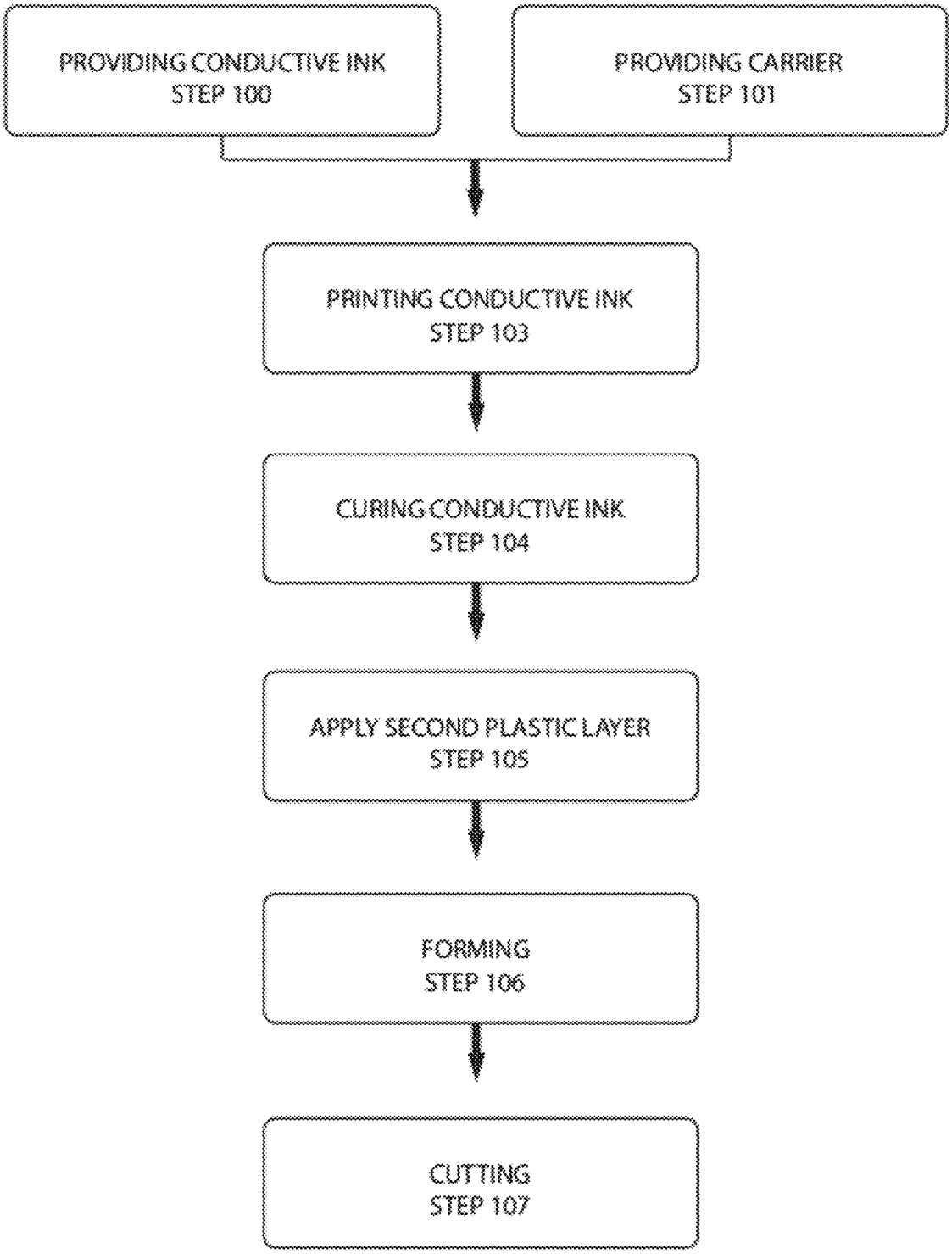
FIG. 1 illustrates a flow diagram in accordance with certain embodiments of the invention where a conductor is applied to the plastic using a printing technique.

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

The antennas and methods described in accordance with embodiments of the present invention reduce the number of components in a wireless antenna to as few as a single component, and thus significantly reduce the complexity and costs associated with antenna fabrication. Embodiments of the invention achieve this goal by manufacturing cost-effective antenna structures using a thermoforming process. Thermoforming may refer to the process of forming a thermoplastic sheet into a three-dimensional shape by clamping the sheet in a frame, heating it to render it soft and pliable, then applying differential pressure to make the sheet conform to the shape of a mold or die positioned below the frame. When pressure is applied entirely by vacuum, the process is called 'vacuum forming'.

In accordance with the various embodiments of the present invention, prior to vacuum forming, a conductive antenna pattern may be printed, deposited, or placed (hereinafter, collectively referred to as 'applied') on a plastic sheet or other non-conductive carrier material. The conductive antenna pattern may be applied to one or both sides of the plastic carrier. In some applications, however, it may be advantageous to use the plastic sheet as a protective layer by applying the antenna pattern to one side of the plastic carrier. This configuration, which may also provide an enhanced cosmetic appearance, can be used to implement an integrated contact point between the antenna terminals and the circuit board of the wireless device. Once the conductive material is applied to the plastic carrier, the vacuum forming process, or other processes for providing a pressure differentiated forming, creates one or more low cost antennas with an integrated plastic carrier. A laser or other cutting mechanism may be used to subsequently cut out individual finished antenna structures that are now ready to be integrated into various communication devices.

The conductive pattern may be applied using a variety of techniques, including, but not limited to, printing conductive (e.g., silver) inks, placing or attaching copper or aluminum sheets, or depositing copper or other conductive materials on the plastic sheet using electro-deposition, or similar techniques. The conductive material may be any one of silver, copper, aluminum, gold, or other conductive elements or composites. In one embodiment, the antenna pattern may be cut, punched, or etched onto the conductive material prior to application to the plastic sheet. It should also be noted that the choice of non-conductive material is not limited to plastic, and it may comprise any material that can be formed by the thermoforming process.

It should also be noted that the thermoforming process can be implemented to fabricate a multi-band antenna wherein a first tuned antenna element is disposed between a first and second carrier sheet, and a second tuned antenna element is disposed between the second carrier sheet and a third carrier sheet, such that the first and second tuned antenna elements are isolated between non-conductive layers of the carrier sheets such that the composite assembly provides a multi-band antenna module. Similarly, an electronic circuit, such as a matching circuit, or other circuit, can be fabricated within a first layer of a multi-layer composite assembly, and one or more antenna elements can be disposed within adjacent layers such that the assembly includes one or more antennas and one or more circuits each being disposed in a separate layer isolated by non-conductive carrier sheets. In addition to providing multiple layers of separation between electrical components, the multiple layers of the assembly have been shown to further provide support integrity to the overall assembly, thus providing a durable antenna module.

Now turning to the drawings, FIG. 1 illustrates a flow diagram of an antenna forming process in accordance with an exemplary embodiment of the present invention. In certain embodiments of a method for fabricating thermoformed antennas, the method includes: (i) providing conductive ink and a carrier sheet such as a plastic sheet; (ii) printing an antenna radiating element on the carrier sheet using the conductive ink; (iii) curing the conductive using either a catalyst such as a chemical or heat; (iv) applying a second carrier sheet above the first carrier sheet and printed conductive ink forming a radiating element sandwiched therebetween; (v) applying a combination of one or more of heat and vacuum to fabricate a thermoformed structure; and (vi) cutting a portion of the thermoformed structure for separating an individual unit.

Figure 2:
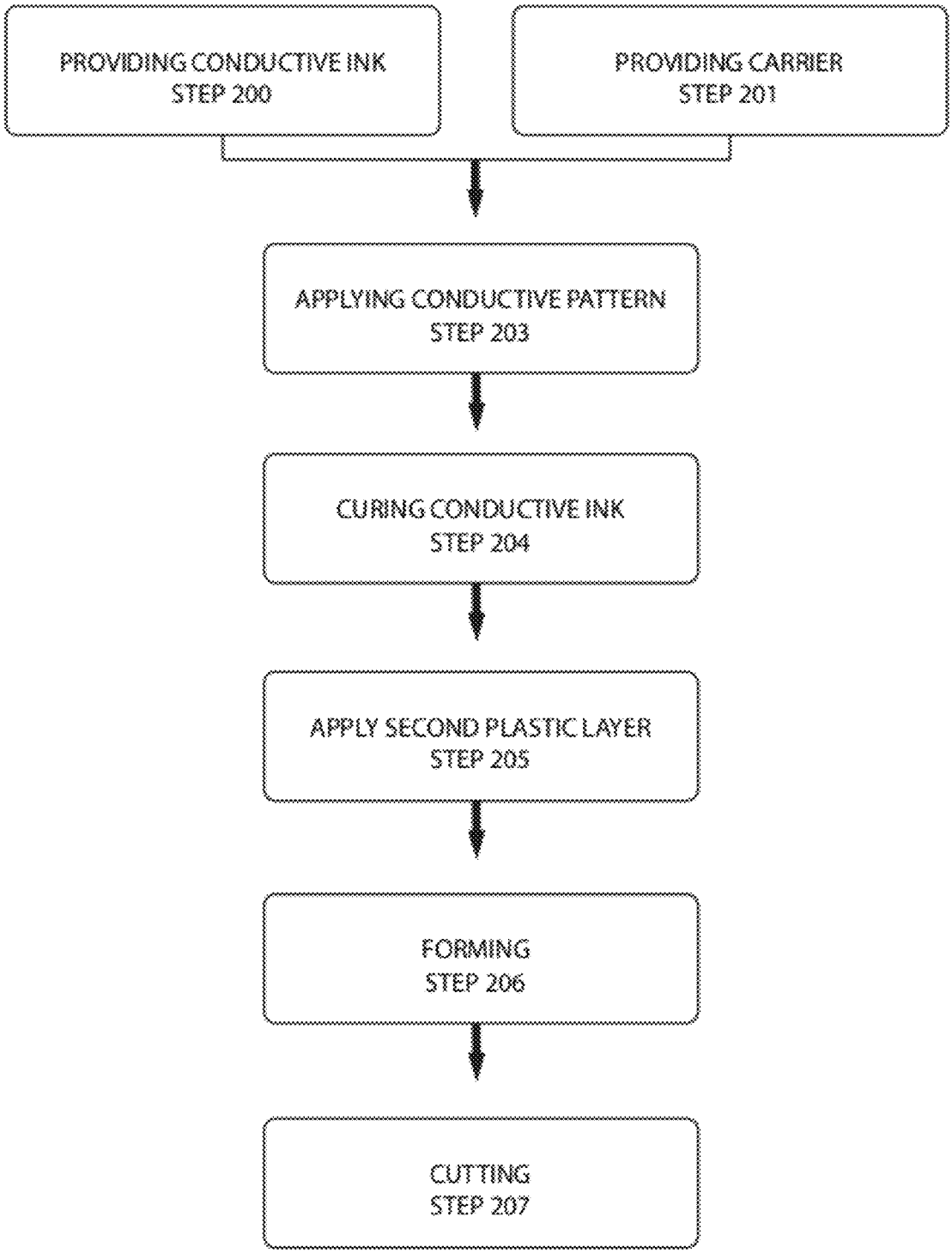
FIG. 2 illustrates a flow diagram in accordance with certain embodiments of the invention where the conductor is applied using anon-printing technique.

FIG. 2 illustrates a similar method of FIG. 1, wherein a conductor is applied to a carrier sheet using a non-printing technique such as electroplating.

Figure 3A:
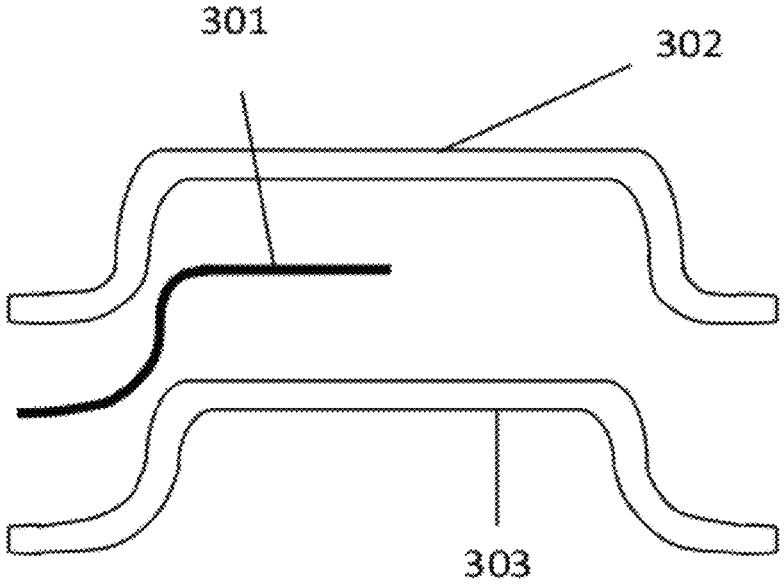
FIGS. 3(*a-b*) illustrate a profile of a composite thermoformed antenna, wherein a conductive layer is applied to a first non-conductive carrier sheet and a second non-conductive carrier sheet is applied to substantially cover the conductive layer such that the conductor becomes isolated within the thermoformed carrier.
Figure 3B:
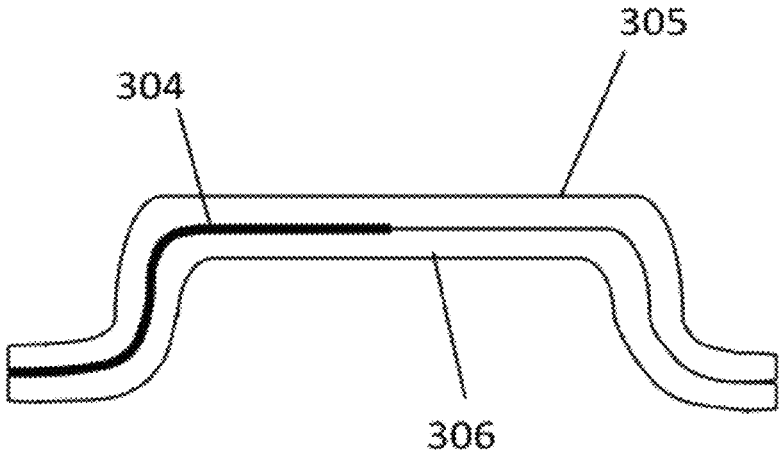

FIG. 3 illustrates a thermoformed antenna in accordance with various embodiments of the invention, wherein a conductor 301 is either printed or otherwise applied to a first carrier sheet 303, and a second carrier sheet 302 is applied to the first carrier sheet and conductor thereon such that the conductor is substantially covered by the first and second carrier sheets. The isolation of the conductor can be used to enhance antenna radiation pattern characteristics, reduce coupling with nearby components, and the like. In this regard, an antenna can be fabricated within a thermoformed three dimensional structure and designed for radiation at a desired frequency band.

Although the printed conductor can define an antenna radiator as described above, similar techniques can be implemented for fabricating one or more parasitic elements or circuits such as antenna tuning circuits.

Figure 4:
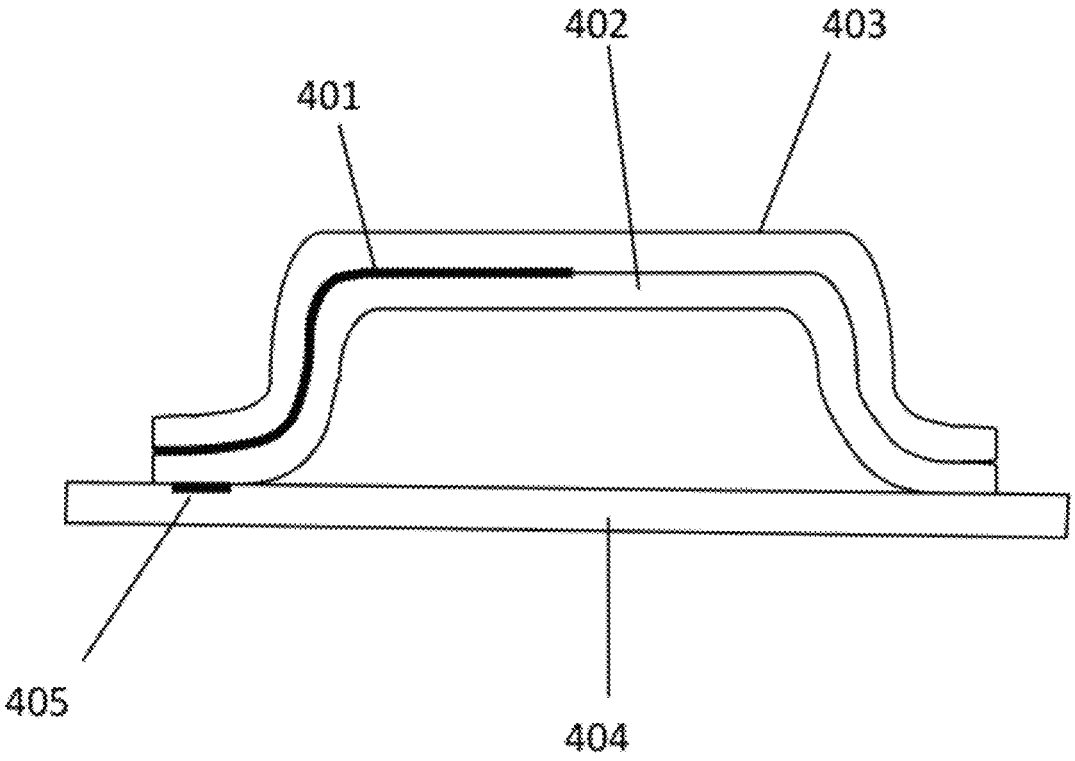
FIG. 4 illustrates a profile of a composite thermoformed antenna, wherein the antenna feed and ground connections are isolated and contained within the non-conductive thermoformed assembly, the antenna feed and or ground connections are adapted to couple with the host device by way of capacitive coupling to a conductive pad on a circuit board of the host device.

FIG. 4 illustrates a thermoformed antenna module comprising a radiating element 401 disposed between a first layer 402 and a second layer 403. A circuit board 404 includes an antenna feed contact 405, and the radiating element is adapted to capacitively couple with the antenna feed element.

Figure 5:
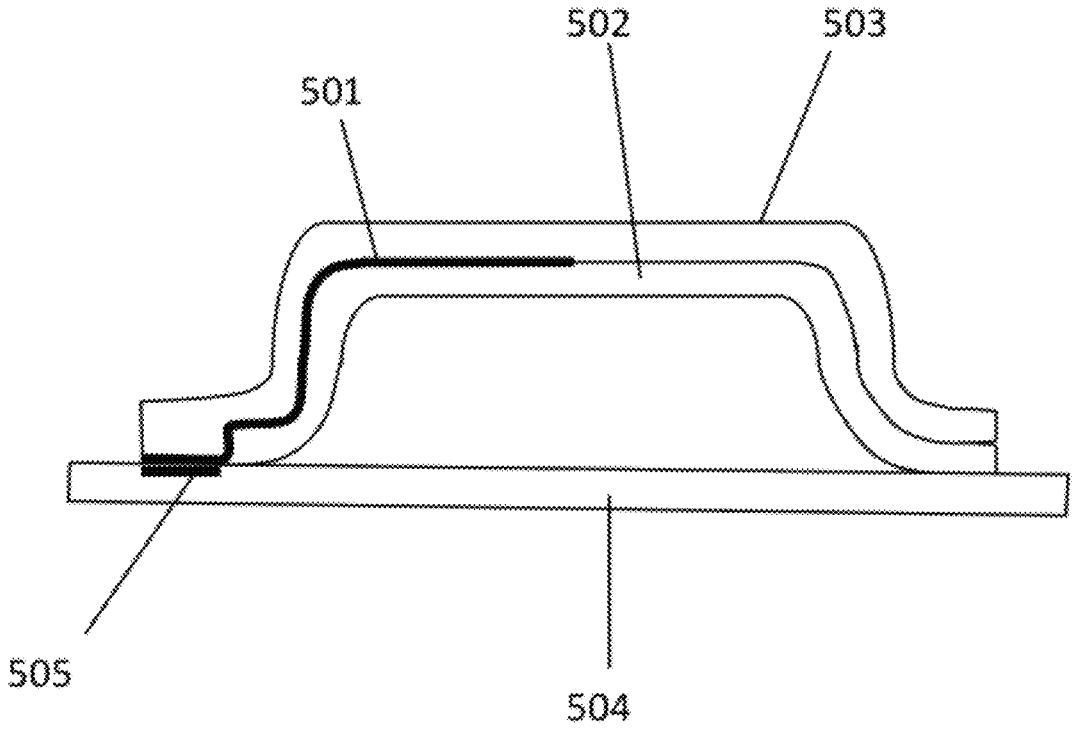
FIG. 5 illustrates a profile of composite thermoformed antenna, wherein the antenna feed and ground connections are exposed through an aperture on one side for providing electrical contact between the antenna and host device.

In another embodiment as described in FIG. 5, the first layer comprising a first carrier sheet further includes one or more apertures. A radiating element 501 is attached to the first carrier sheet 502 and positioned above one or more of the apertures. A second carrier sheet 503 is then attached to the radiating element and first carrier sheet and the structure is thermoformed into a three dimensional antenna module. The radiating element is adapted to physically contact an antenna feed 505 of a circuit board 504 through one or more of the apertures.

Figure 6A:
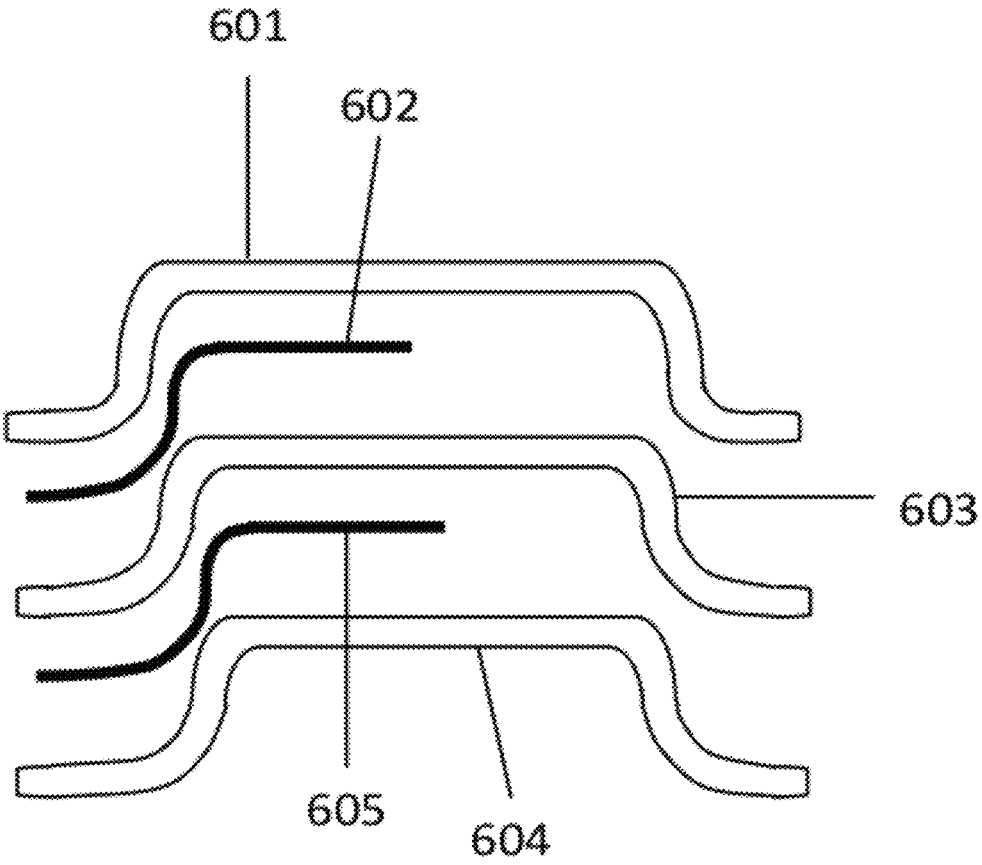
FIGS. 6(*a-b*) illustrate a profile of a composite thermoformed structure, wherein a plurality of non-conductive sheets are incorporated for supporting and separating multiple conductive layers being disposed therebetween.
Figure 6B:
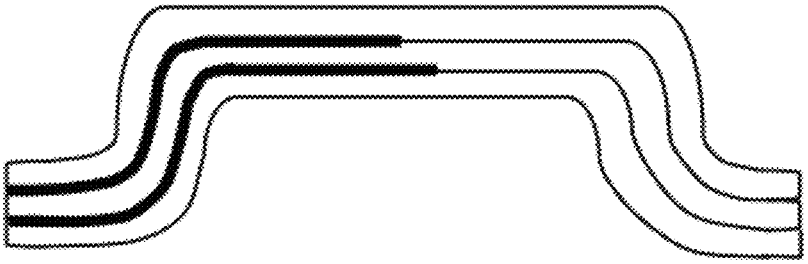

FIG. 6 illustrates a multi-layer thermoformed antenna assembly, the assembly including a first carrier sheet 604 having attached a first conductor 605, a second carrier sheet 603 disposed above the first carrier sheet substantially containing the first conductor between the first and second carrier sheets, a second conductor 602 attached to an outer surface of the second carrier sheet and a third carrier sheet 601 disposed thereon. The assembly is thermoformed to yield a three dimensional antenna structure comprising a first isolated conductor and a second isolated conductor. In this embodiment, the second conductor substantially overlays and surrounds the first conductor.

Figure 7A:
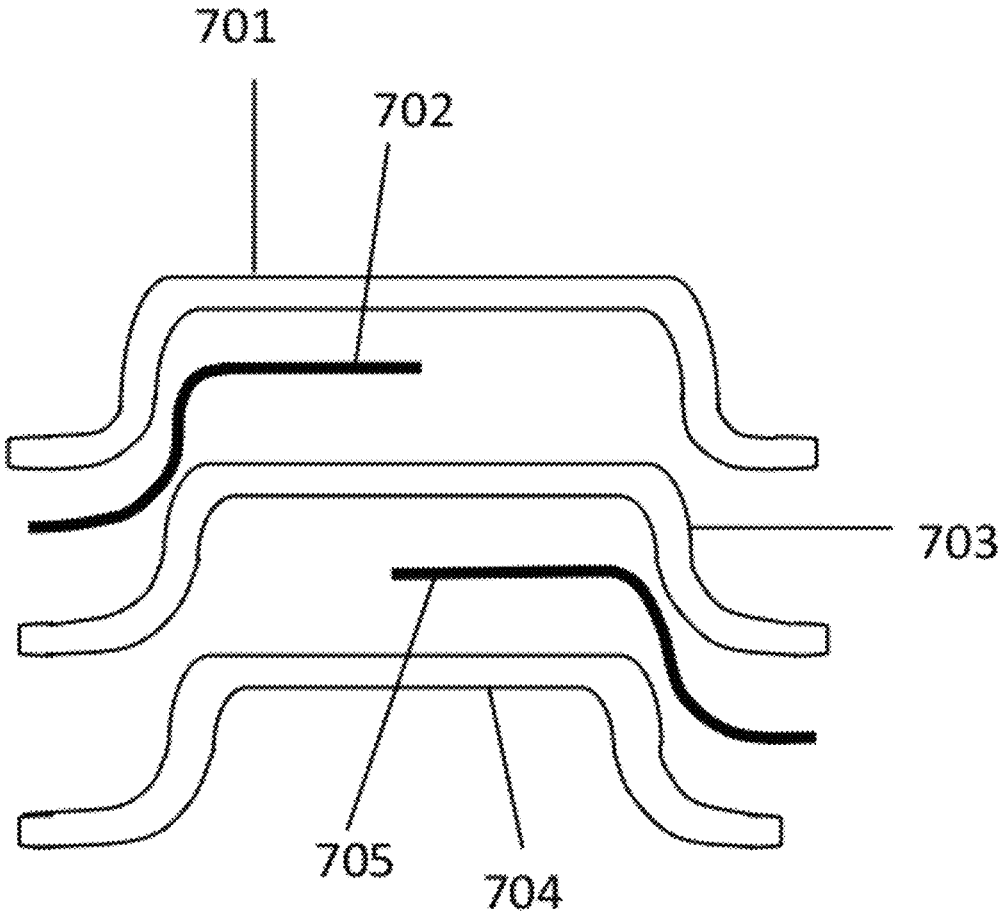
FIGS. 7(*a-b*) illustrate a composite thermoformed structure, wherein a plurality of non-conductive sheets are incorporated for supporting and separating multiple conductive layers being disposed therebetween, and wherein the conductive layers are deposited on opposite sidewalls of the thermoformed plastic.
Figure 7B:
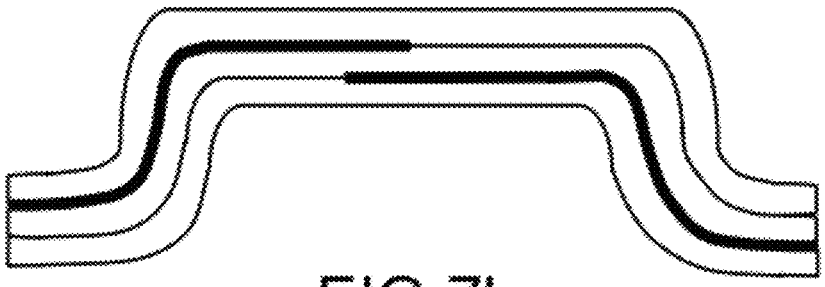

In another embodiment, the thermoformed antenna can include two or more conductors being oppositely disposed as illustrated in FIG. 7. A first carrier sheet 704 is configured with a first conductor 705 configured thereon, the first conductor is attached at a first end and extends along a surface of the first carrier sheet toward a center thereof. A second carrier sheet 703 is further disposed above the first conductor and first carrier sheet. A second conductor 702 is configured on a surface of the second carrier sheet, and is attached to the second carrier sheet at a second end and extending toward a center thereof. The first and second conductors are oriented opposite with respect to one another. A gap can be configured between one or more overlaying portions of the first and second conductors for creating a capacitive area therebetween. The capacitive area can be utilized to tune the resonance of the antenna. A third carrier sheet 701 is further disposed above the second conductor and second carrier sheet. The assembly is thermoformed to provide a three dimensional antenna structure.

Figure 8:
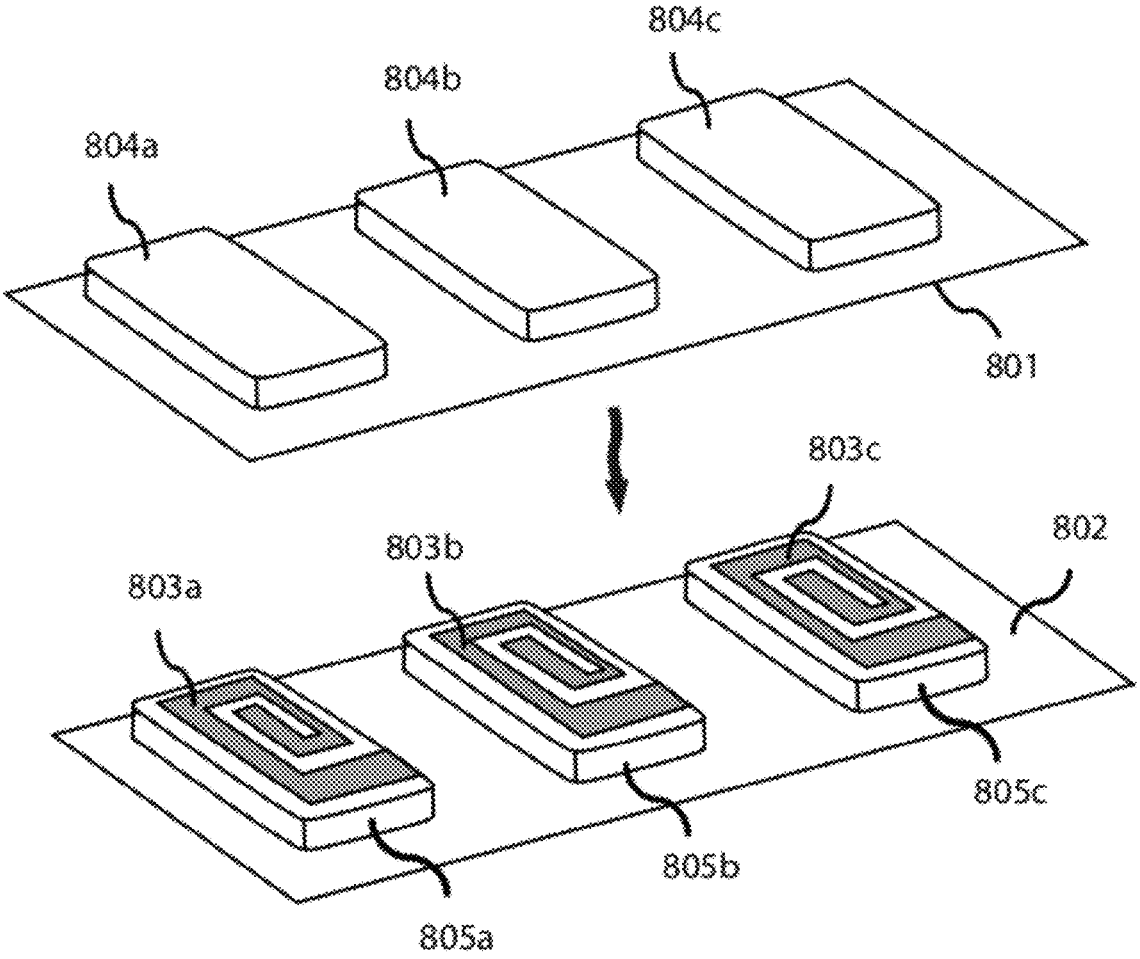
FIG. 8 illustrates an exploded view of a composite thermoformed antenna according to various embodiments of the invention, wherein composite thermoformed structures are fabricated using a tape and reel process, one plastic reel containing first thermoformed structures with conductive elements is fabricated along with a second plastic reel containing second thermoformed structures, the two thermoformed reels are further combined to form a reel of composite thermoformed antennas.

In certain embodiments as illustrated by the exploded thermoformed antennas according to FIG. 8, a tape and reel process can be utilized for high throughput fabrication of three dimensional antenna structures. In this regard, a first carrier sheet 802 is used as a base for attaching one or more conductive portions 803*a-c*. The conductive portions can be configured as antenna radiating elements, parasitic elements, circuit components, or traces. A second carrier sheet 801 is subsequently attached to the first carrier sheet and attached components and the module is thermoformed. For example, a first carrier can be spooled from a first reel and conductors printed or otherwise attached thereto, a second carrier sheet can be spooled from a second reel, and the combined first and second carrier sheets with conductors attached thereon can be thermoformed with the application of heat and vacuum. Additionally, the thermoformed antenna structures can be cut into a number of individual units for use in electronics products.

In certain embodiments, the printed antenna radiating element can comprise an isolated magnetic dipole (IMD). In general, the IMD comprises a capacitive region and a magnetic loop radiator setting up a dipole moment. In this regard, the capacitive loading from the capacitive region can be designed to cancel the impedance of the resonant structure.

FIGS. 9(*a-c*) illustrate examples of IMD structures that can be configured using the herein-described thermoformed methods.

Figure 9A:
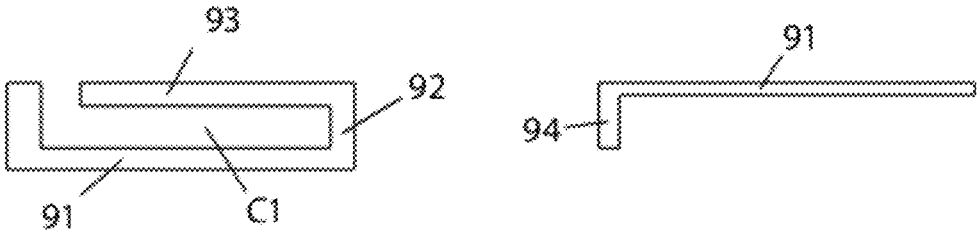
FIG. 9 illustrates several example antennas for use in various embodiments of the invention.

FIG. 9*a* illustrates a single resonance IMD element comprising a first elongated conductor 91 oriented parallel to a second elongated conductor 92, the first and second elongated conductors are connected by a connecting conductor 93 at a first end. The first elongated conductor 91 is further connected to feed and/or ground. The first elongated conductor 91, connecting conductor 93, and second elongated conductor form a u-shaped inductive loop setting up a single resonance magnetic dipole. Moreover, the capacitive region C1 loads the magnetic dipole. The single resonance IMD element is connected to feed and/or ground via a vertical conductor 94.

Figure 9B:
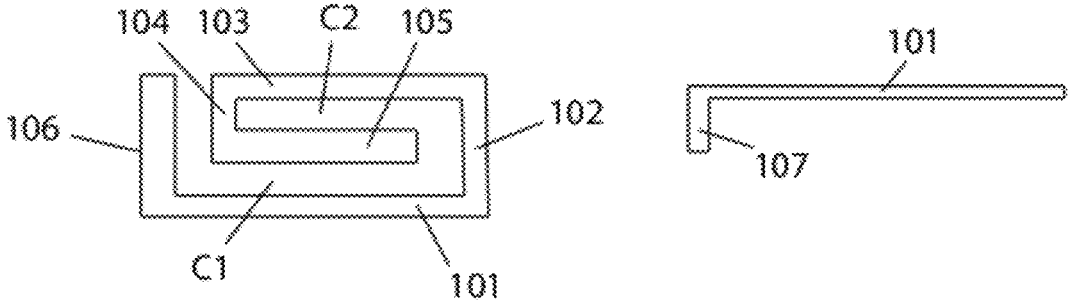

FIG. 9*b* illustrates a dual resonance IMD antenna structure, the dual resonance IMD comprises a first elongated conductor 101, a second elongated conductor 103, and a third elongated conductor 105 each aligned parallel to one another. The first and second elongated conductors are connected at a first end by a first connecting conductor 102. The second and third elongated conductors are connected at a second end by a second connecting conductor 104. A first u-shaped loop consists of the first elongated conductor 101, first connecting conductor 102, and second elongated conductor 103, setting up a first magnetic mode and capacitively loaded by the first capacitive region C1. A second u-shaped loop consists of the second elongated conductor 103, second connecting conductor 104, and third elongated conductor 105, setting up a second magnetic mode and capacitively loaded by the second capacitive region C2. In this regard, the antenna is configured for radiation at two resonant frequencies. The dual resonance IMD element is connected to feed and/or ground via a vertical conductor 107.

Figure 9C:
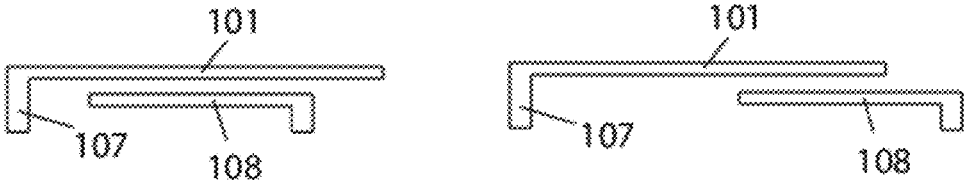

FIG. 9*c* illustrates an IMD element disposed adjacent to a parasitic element 108. Although the dual resonance IMD element is indicated in FIG. 9*c*, any IMD or other antenna structure may be provided adjacent to a parasitic element. In this regard, up to several layers of dielectric material may separate the antenna element from the parasitic element.

Each of the examples of FIGS. 9(*a-c*) can be configured into a composite thermoformed assembly as described herein. Moreover, those having skill in the art will recognize that several variations are possible.

The above examples are set forth for illustrative purposes and are not intended to limit the spirit and scope of the invention. One having skill in the art will recognize that deviations from the aforementioned examples can be created which substantially perform the same functions and obtain similar results.

What is claimed is:

1. A method for manufacturing a plurality of composite thermoformed antennas, comprising:

providing a first electrically non-conductive carrier sheet having a first surface and a second surface opposite of the first surface;

applying at least a first conductive layer on the first surface of the first carrier sheet, the first conductive layer including a plurality of conductive portions, each of the conductive portions forming one of: an antenna radiating element, a parasitic element, or an antenna tuning circuit;

providing a second electrically non-conductive carrier sheet;

combining the second carrier sheet with the first carrier sheet such that the first conductive layer is disposed therebetween, wherein the first carrier sheet, first conductive layer, and second carrier sheet form a multi-layer assembly;

applying heat, vacuum, or a combination thereof to the multi-layer assembly to form a multi-antenna array including a plurality of three-dimensional antennas thereof; and cutting the multi-antenna array to produce a plurality of three-dimensional antennas.

2. The method of claim 1, further comprising:

applying a second conductive layer to one of: the second surface of the first carrier sheet, or a surface of the second carrier sheet.

3. The method of claim 2, further comprising:

providing a third electrically non-conductive carrier sheet; and combining the third carrier sheet with the first carrier sheet, first conductive layer, second carrier sheet, and second conductive layer such that each of the first and second conductive layers is independently disposed between two of: the first through third carrier sheets.

4. The method of claim 3, with one of the first through third carrier sheets individually comprising one or more apertures, the method further comprising:

combining the first through third layers such that the layer comprising the one or more apertures is configured as a bottom layer of the multi-layer assembly; and aligning the one or more apertures of the bottom layer with one of the first and second conductive layers for exposing a contact point thereof through each of the one or more apertures.

5. The method of claim 2, wherein said first conductive layer includes one or more antenna radiating elements; and wherein at least one of said first and second conductive layers includes one or more parasitic elements.

6. The method of claim 5, wherein said first and second conductive layers are separated by at least one of the first through third carrier sheets; and wherein said first and second conductive layers are separated by a dielectric material.

7. The method of claim 5, wherein said one or more antenna radiating elements includes a first antenna radiating element configured with at least a first resonance, and a second antenna radiating element configured with at least a second resonance, wherein the second resonance is distinct from the first resonance, and wherein the resulting three-dimensional antennas comprise multi-band antennas.

8. The method of claim 1, wherein said first conductive layer includes one or more antenna radiating elements.

9. The method of claim 1, wherein said applying includes one of:

printing conductive ink or electroplating.

* * * * *